United States Patent [19]

Waters et al.

[11] 4,225,852

[45] Sep. 30, 1980

[54] PATIENT CARE TIMER

[76] Inventors: Ronald L. Waters, 1090 El Camino Dr.; Thomas J. Grady, 1122 Corona La., both of Costa Mesa, Calif. 92626; Thomas F. Brown, 324 Collidge Ave., Anaheim, Calif. 92801; E. Shirley Long, 917 Claiborne Dr., Long Beach, Calif. 90807

[21] Appl. No.: 875,149

[22] Filed: Feb. 6, 1978

[51] Int. Cl.[2] ..... G08B 3/10; H04N 7/00

[52] U.S. Cl. ..... 340/286 R; 340/327; 340/309.1

[58] Field of Search ..... 340/286 R, 327, 309.1

[56] References Cited

U.S. PATENT DOCUMENTS 3,668,682 6/1972 Barber ..... 340/286

*Primary Examiner*—Harold I. Pitts

*Attorney, Agent, or Firm*—I. Michael Bak-Boychuk

[57] ABSTRACT

A resettable timer conformed as an interface assembly between a nurse call button and the wall jack therefor, including a D.C. power supply driving a timing circuit which closes a switch in parallel with the call button at the completion of a predetermined interval of time. The arrangement of this timing circuit into an interface stage received in the jack at the patients bedside requires that the nurse visit the patient in order to effect a reset. Thus the nurses call signal will remain on in an indistinguishable manner from an emergency signal, calling for response which can only be corrected by a visit to the patient's room.

6 Claims, 2 Drawing Figures

PATIENT CARE TIMER

BACKGROUND OF THE INVENTION

1. Field of the Invention

The present invention relates to timing devices, and more particularly to timing adaptors useful with hospital communication circuits.

2. Description of the Prior Art

In many health care facilities the treatment, care or monitoring often extends to patients who, because of various infirmities, are immobile or unconscious. Patients in this state require either periodic assistance or periodic inspection around the clock which is therefore delegated to nursing personnel, one nurse or attendant servicing many patients in order to conserve the costs of medical care. Because of the vagaries and imperfections of a human mind and sometimes frequent periods of inattentiveness such immobile patients are often left uncared for periods greater than periods medically acceptable. One exemplary phenomenon of this inattendance is the development of bedsores on the body of a patient, an injury, which can be prevented with periodic care if such is performed with regularity.

Concurrent with this periodic care the nurse or attendant is maintained proximate the patients to provide emergency corrections or to attend to discomforts that a patient may be experiencing. For this reason most health care facilities and particularly those where patients are confined to a bed, include a call buzzer system, each room or bed being typically provided with a wall jack for receiving a call button manipulated by the patient. The jacks, in turn, are connected to a central panel monitored by a nurse or attendant. Because of the unknown character of the call, these signals are typically responded to with greater diligence.

SUMMARY OF THE INVENTION

Accordingly, it is the general purpose and object of the present invention to provide a timer assembly conformed as an interface and insertable into the call button jack for producing periodic call signals.

Other objects of the invention are to provide a timer assembly connected to a call button circuit which is manually resettable.

Further objects of the invention are to utilize the nurse call system of a health care facility to provide periodic care signals.

Briefly these and other objects are accomplished within the present invention by conforming a timing circuit for articulation of a switch in parallel with a call switch. The timing circuit itself may be a DC powered counter driven by an oscillator, a preselected count signal being looped back to disable the counter and also exciting a relay to close a switch. This switch is deployed across the terminals of a male connector, in parallel with a jack adapted to receive a conventional nurse call button. Thus at the completion of the preselected count a signal path is completed simulating a nurse call and will be maintained until the disabling loop is interrupted. For this purpose a manually articulated push-to-open switch is installed onto the timer assembly resetting the timing count at each manual articulation.

The foregoing features are integrated into a single assembly conformed as an interface between the wall jack and the insert at the end of a call button cord and are therefore located at the bedside of a patient. The resetting signal is indistinguishable from a patient call signal, thus requiring the same degree of diligence in response.

DESCRIPTION OF THE SPECIFIC EMBODIMENT

Figure 1:
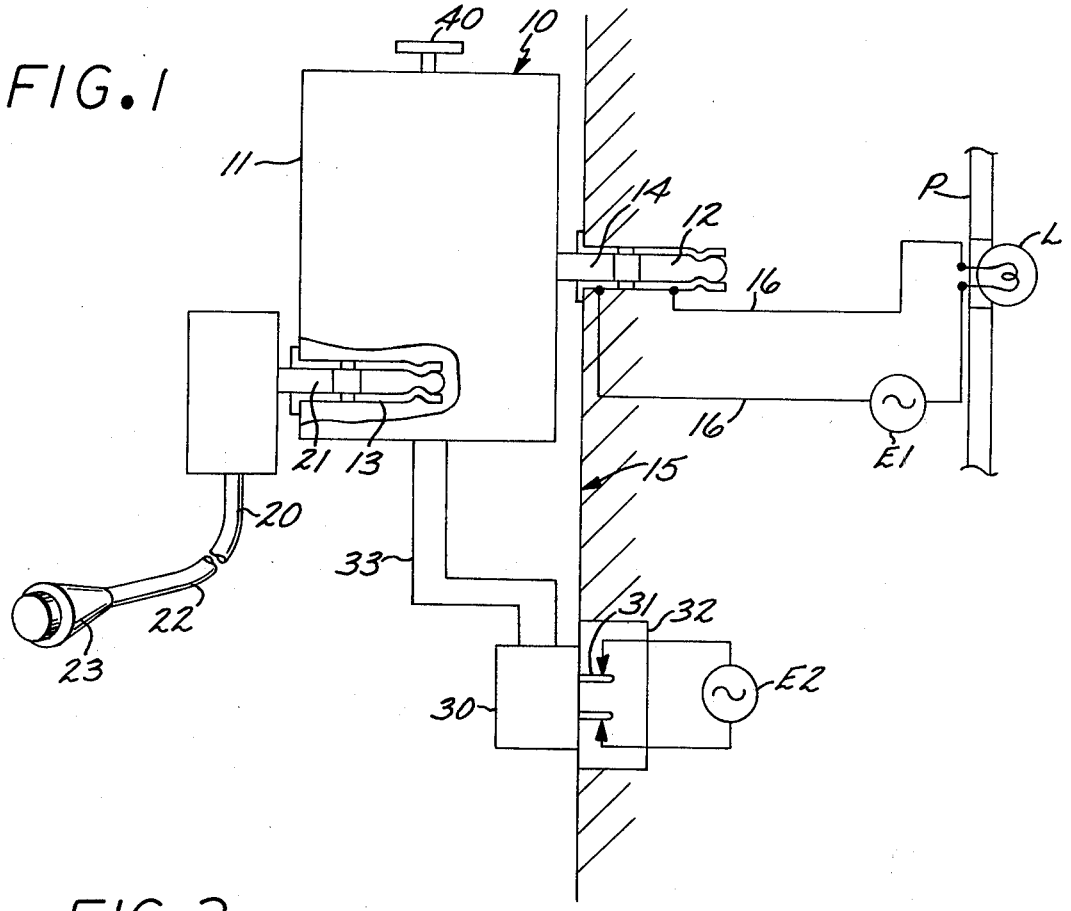
FIG. 1 is a diagrammatic illustration of an inventive timing circuit assembly useful with a nurse calling system of a medical care facility.

As shown in FIG. 1 a resettable timer generally designated by the numeral 10 comprises a rectangular housing 11 having a two-terminal coaxial jack connector 12 extending from one lateral surface thereof and a coaxial receptacle 13 mounted in another surface thereof. The terminals of connector 12 are arranged for contact with the interior terminals of a wall jack 14 mounted in a wall 15. The terminals of wall jack 14, in turn, are connected to the ends of a circuit 16 which includes a first source of electrical excitation E in series with an indicator lamp L. Jack 14, circuit 16, Lamp L, and and source E, in simplified form, illustrate a typical prior art nurse calling system, lamp L being mounted in a nurse station panel P, one such lamp indicating one nurse calling signal originated by a patient.

The remaining part of the prior art call system comprises a call button assembly generally designated by the numeral 20 having yet another coaxial connector 21 at one end of a cord 22 which terminates in a call button 23 at the other end. Connector 21 is receivable in the receptacle 13 in this manner of assembly, the timer 10 forming an interface at the point of the prior insertion of connector 21 in jack 14.

While there are various possible alternatives for providing power to the timer 10, shown in FIG. 1 is a DC power supply 30 provided with a two-prong connector 31 on one surface thereof, connector 31 being receivable in a conventional wall outlet 32 excited by a second source of electrical excitation $E_2$. Power supply 30 is, in turn, connected by way of a two-strand lead 33, to the timer 10 providing power thereto according to the description following.

Timer 10 is, furthermore, provided with a manual push-to-open reset button 40, thus requiring manual intervention at a location adjacent jack 14 which typically is proximate the patient. While the illustration herein deploys button 40, receptacle 13, connector 12 and lead 33 at various surfaces of the housing 11 this arrangement is for convenience primarily. Should space restriction so dictate, other arrangements are possible, such further implementation placing timer 10 directly into wall 15 as a built-in alternative.

Figure 2:
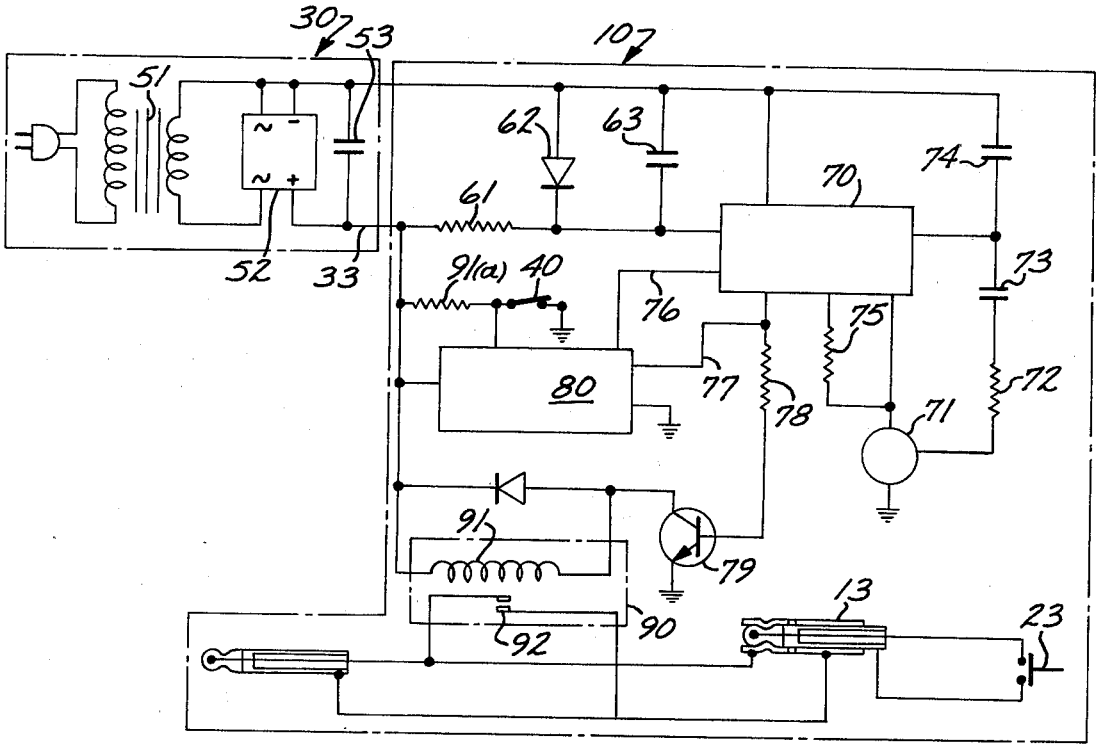
FIG. 2 is a circuit diagram illustrating the circuit arrangement of the timing assembly shown in FIG. 1.

The circuit implementation of the timer 10 and power supply 30 is shown in FIG. 2. As shown in this Figure, the power supply 30 includes the necessary dropping transformer 51 disposed between the plug terminals 31 and a full wave bridge rectifier 52. A capacitor 53 is also included to attenuate ripple and to smooth the rectified signal. Within the timer 10 the output of supply 30 is regulated by way of a resistor 61 and a Zener diode 62 in parallel with a capacitor 63. The DC power developed is applied to the supply inputs of two binary counters, one shown as counter 70 being conformed for oscillator input while the other, shown as counter 80, operating to expand the bit count. The most significant bit terminal of counter 70 is connected to apply the count input to counter 80, a selected bit terminal of counter 80 being returned to the hold or disable terminal of counter 70, to terminate the count. Counters 70 and 80 may be any conventional counters in the art a CMOS counter made by National Semiconductor, Model No. 4060 being useful to provide the operation of counter 70 while Model No. 4020 by the same manufacturer being utilized as the counter 80 stage. As set out by the manufacturer, counter 70 includes the necessary preconditioning section to receive the output of a crystal oscillator 71.

More specifically, oscillator 71 is connected at its output to reference ground by a circuit including a resistor 72 in series with a capacitor 73 and a capacitor 74. The juncture between capacitors 73 and 74 provides the oscillatory input to the preconditioning stage advancing the counters, counter 70, together with capacitors 63, 73 and 74 and crystal 71 forming thus a tuned resonating circuit of preselected frequency. Concurrently the other terminal of the oscillator 71 is tied by a resistor 75 to the counter 70 and directly to the enable terminal thereof. The most significant bit output of counter 70 is tied by way of a lead 76 to the count terminal of counter 80, a selected bit terminal of this counter being fed back to the disable terminal of counter 70 by a lead 77. This disable signal terminates the count at a predetermined count level, holding counter 80 until power is removed or until reset. Concurrently this same signal path is utilized to provide the alternative call signal. More specifically, lead 77 is tied through a base resistor 78 to a switching transistor 79. Transistor 79 is connected, in a common emmitter configuration, to the output side of a winding 91 included in a read relay 90 which also includes the necessary contacts 92 which are pulled closed upon the excitation of winding 91. Winding 91 is tied to the positive output of power supply 30 for such excitation and will close the contacts when transistor 79 is conducting, which occurs when counter 80 is advanced to the selected count position. Thus, contacts 92 will be pulled closed and counter 70 will be disabled concurrently.

Contacts 92, in turn, connected across the terminals of connector 12 providing a parallel switching path to the call switch 23, shown inserted in the receptacle 13. Thus, a nurse calling signal is produced until reset.

The reset is achieved by connecting the reset switch 40 from one end of a resistor 91 to ground. The other end of resistor **91*a* is tied to the power input lead, resistor 91*a* being also tied to the reset terminal of counter 80. Thus when the reset switch is manually opened the reset terminal of counter 80 is pulled high resetting the counter and unlatching the feedback lead 77. Depending on the frequency of oscillator 71 and the count length selected, this will continue until the selected bit in counter 80** is again reached. In this manner the timing interval is repeated after each reset.

Obviously many modifications and variations to the above disclosure can be made without departing from the spirit of the invention. It is therefore intended that the scope of the invention be determined solely on the claims appended hereto.

What is claimed is:

1. In a medical care facility including designated areas for the care of patients; a monitoring station for receiving signals enabled by said patients and signal generating means deployed proximate each said patient, said signal generating means including a plurality of signal lines each extending from said monitoring station to a corresponding wall jack proximate said patients a corresponding plurality of manually operable call switches each adapted for manipulation by said patients, and a corresponding plurality of connectors deployed from the respective ones of said call buttons for insertion into said wall jacks, the improvement comprising:

a resettable timer assembly including a plug adapted for insertion into said wall jack and provided with a receptacle in circuit with said plug for receiving said connector, said timer assembly including exciting means for producing electrical excitation, timing means connected to said exciting means for producing a timing signal a predetermined period of time after the receipt of said electrical excitation, manually operable resetting means connected to said timing means for restarting said timing means after said timing signal is produced thereby and for disabling said timing signal for yet another said predetermined period of time, and switch means connected across said receptacle rendered closed by said timing signal.

2. Apparatus according to claim 1 wherein:

said timer assembly is conformed for deployment proximate said wall jack; and said manually operable resetting means includes a pushbutton switch deployed on the exterior of said timer assembly.

3. Apparatus according to claim 2 wherein:

said switch means includes a normally open set of contacts connected across said receptacle and a winding connected to receive said timing signal for electromagnetically closing said set of contacts.

4. Apparatus according to claim 3 wherein:

said timing means includes an oscillator rendered operative by said electrical excitation, a counter connected to said oscillator for producing a series of count signals indicative of the accumulated count of the oscillations from said oscillator, said counter including a disable and hold segment connected to a preselected one of said count signals for disabling said counter, and an enable segment connected to said resetting means for resetting said disable and hold segment and said counter upon the manual operation of said resetting means.

5. Apparatus according to claim 4 wherein:

said switch means is arranged for parallel operation with said call button.

6. Apparatus according to claim 5 wherein:

said timing assembly is removeably deployed in said wall jack.

* * * * *